United States Patent [19]

Deal

[11] Patent Number: 4,575,960

[45] Date of Patent: Mar. 18, 1986

[54] DREDGE CUTTERHEAD

[76] Inventor: Troy M. Deal, 277 Trismen Ter., Winter Park, Fla. 32789

[21] Appl. No.: 669,058

[22] Filed: Nov. 7, 1984

Related U.S. Application Data

[63] Continuation of Ser. No. 472,974, Mar. 7, 1983, abandoned, which is a continuation-in-part of Ser. No. 221,219, Dec. 30, 1980, abandoned.

[51] Int. Cl.[4] ..... E02F 3/88

[52] U.S. Cl. ..... 37/63; 37/65; 37/66

[58] Field of Search ..... 37/66, 61, 62, 63, 195, 37/64, 65

[56] References Cited

U.S. PATENT DOCUMENTS

| | | | |
|---|---|---|---|
| 501,870 | 7/1893 | Collins | 37/63 X |
| 660,956 | 10/1900 | Henderson | 37/66 |
| 2,879,649 | 3/1959 | Elliott | 61/72 |
| 3,461,579 | 8/1969 | Turner | 37/189 |
| 3,473,243 | 10/1969 | Turner | 37/189 |
| 3,521,387 | 7/1970 | Degelman | 37/66 |
| 3,576,111 | 4/1971 | Henry, Jr. | 37/63 X |
| 3,605,296 | 9/1971 | Dysart | 37/66 X |
| 3,738,029 | 6/1973 | Harmon | 37/66 |
| 3,874,101 | 4/1975 | Cummins | 37/69 |
| 3,916,543 | 11/1975 | Poche | 37/93 |
| 3,962,803 | 6/1976 | O'Brien | 37/66 |
| 3,964,184 | 6/1976 | Mathieu | 37/195 |
| 3,971,148 | 7/1976 | Deal | 37/66 |
| 4,095,545 | 6/1978 | Vaughn et al. | 37/66 X |
| 4,104,813 | 8/1978 | Lindsey | 37/57 |
| 4,193,217 | 3/1980 | Poche | 37/93 |
| 4,261,117 | 4/1981 | Van der Peyl | 37/58 |

FOREIGN PATENT DOCUMENTS

| | | | |
|---|---|---|---|
| 1634762 | 8/1970 | Fed. Rep. of Germany . | |
| 6604311 | 10/1967 | Netherlands | 37/61 |
| 7410222 | 2/1976 | Netherlands . | |
| 7703482 | 10/1978 | Netherlands . | |
| 215600 | 5/1924 | United Kingdom . | |
| 949767 | 2/1964 | United Kingdom . | |
| 242055 | 9/1969 | U.S.S.R. | 37/63 |
| 757649 | 8/1980 | U.S.S.R. . | |

OTHER PUBLICATIONS

Citrus-Hernando Times—Summer, 1979—"Citrus Eyes Hungry Giant in Weed-Harvesting Machine".

North Port News—Feb. 15, 1979—"New Machine Clears Weed Choked Waterways".

Fort Myers News—Jun. 3, 1979—"Bass Fishing Could be Ruined by Weed Eater".

Land & Water—Jul., 1979—"'Water-Weeder' Tangles with a Mess".

Ucala Star-Banner—Aug. 2, 1979—"Cirtus Eyes 'Weed-Eater'".

Citrus County Chronicle—Aug. 4, 1979—"Weed Eating Machine Could Clean Waterways".

Fort Myers News—Sep. 16, 1979—"Dredged Boat Trails Help Lake Trafford".

Lehigh News—Oct. 3, 1979—"Water Weeder is Busy Clearing Canals".

*Primary Examiner*—Clifford D. Crowder

*Attorney, Agent, or Firm*—Beaman & Beaman

[57] ABSTRACT

Dredge head and method of using the same in which the solids of the interface between the consolidated soil and the water source are released as a slurry into the atmosphere adjacent the swath cut by the dredge head to deposit the solids remote from the swath.

2 Claims, 9 Drawing Figures

DREDGE CUTTERHEAD

Figure 1:
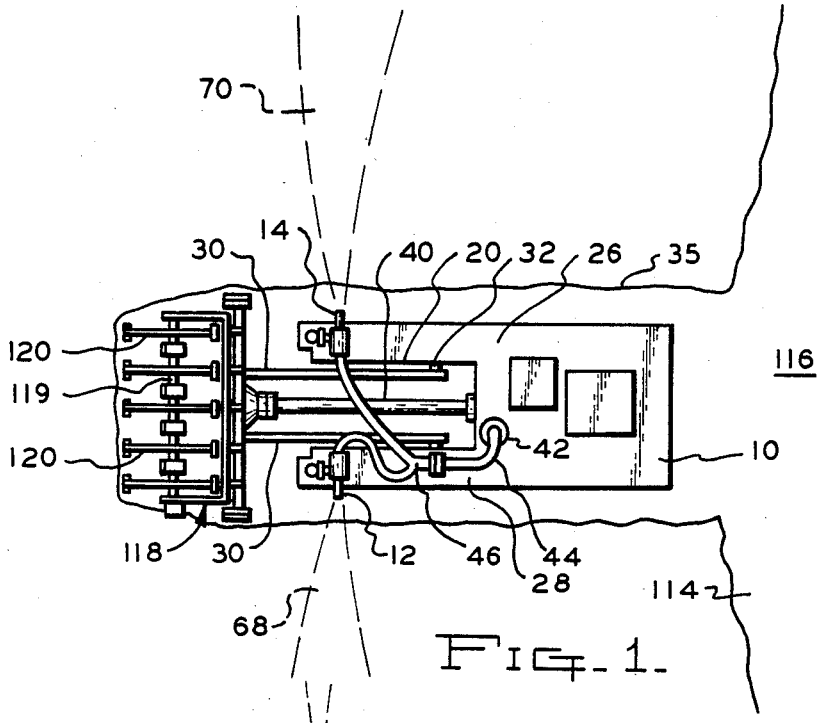

This is a continuation of Ser. No. 472,974, filed Mar. 7, 1983, now abandoned, which is a continuation-in-part of Ser. No. 221,219, filed Dec. 30, 1980, now abandoned.

It has now been experimentally determined that the concept of said application with respect to the aerial disposal of the excavated material has broader application than aquatic growths and unconsolidated matter wherein a slurry is jet sprayed having a solids content in the order of 5–10%.

By modifying the cutterhead and combining with it means for facilitating and controlling the forward movement of the cutter head into the material to be excavated, it becomes practical to use the concept of said application to dredge consolidated material. For example, it may be used to provide navigable channels in upland as well as to deepen waterways with relatively consolidated bottoms.

With adequate power means for providing a substantially continuous controlled advance of the cutterhead into the consolidated material to be excavated, a slurry having a much higher solids content may be aerially handled with all the advantages of said application.

The cutterhead of my U.S. Pat. No. 3,971,148 issued July 27, 1976, as disclosed in said copending application, involved the use of two pairs of horizontally aligned and supported augers supported at their outer and inner ends in bearing and chain cases. When used to cut a swath, the forward faces of the cases presented abutments to the interface between the consolidated soil and the water supply used to slurry the excavated material. These abutments resist the desired continuous movement along the longitudinal axis of the swath being dredged.

According to the present invention, the box section cutterhead has been modified to provide a continuous cutting action at the interface between the consolidated soil and the water supply, the full width of swath. In one form, forward of each bearing and chain case is a rotated vertical shaft upon which is provided soil tilling means which break up and direct the soil confronting the cases toward the intake zone. Another form of the invention shows the use of high pressure water jets for breaking up the consolidated soil forward of abutment structure of the cutterhead presented to said interface.

As illustrated, the cutterhead of said patent is provided with an additional set of horizontal augers. Forward of each bearing and chain case is a vertical shaft for rotating the tilling members.

If desired, a suitable rake, rotated about a horizontal axis may be associated with the cutterhead as a superstructure disposed forward of the cutterhead as disclosed in said copending application.

In experimental practice of the invention, it has been found advantageous, in order to handle slurries having a percentage of solids in excess of 5–10%, to equip the cutterhead with one or more high pressure water jets directed into the intake zone to mitigate cavitation, reduce clogging and to dilute the slurry.

Figure 2:
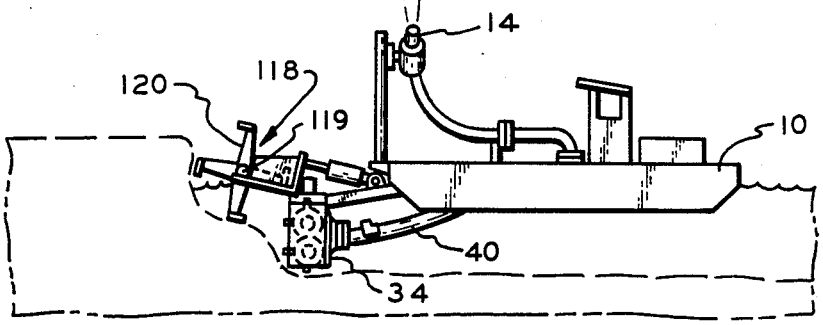
Figure 4:
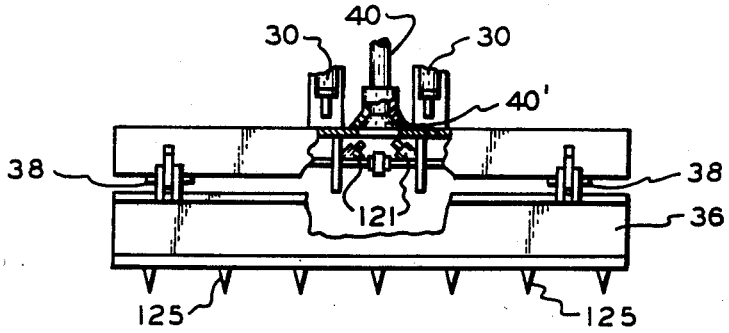
Figure 3:
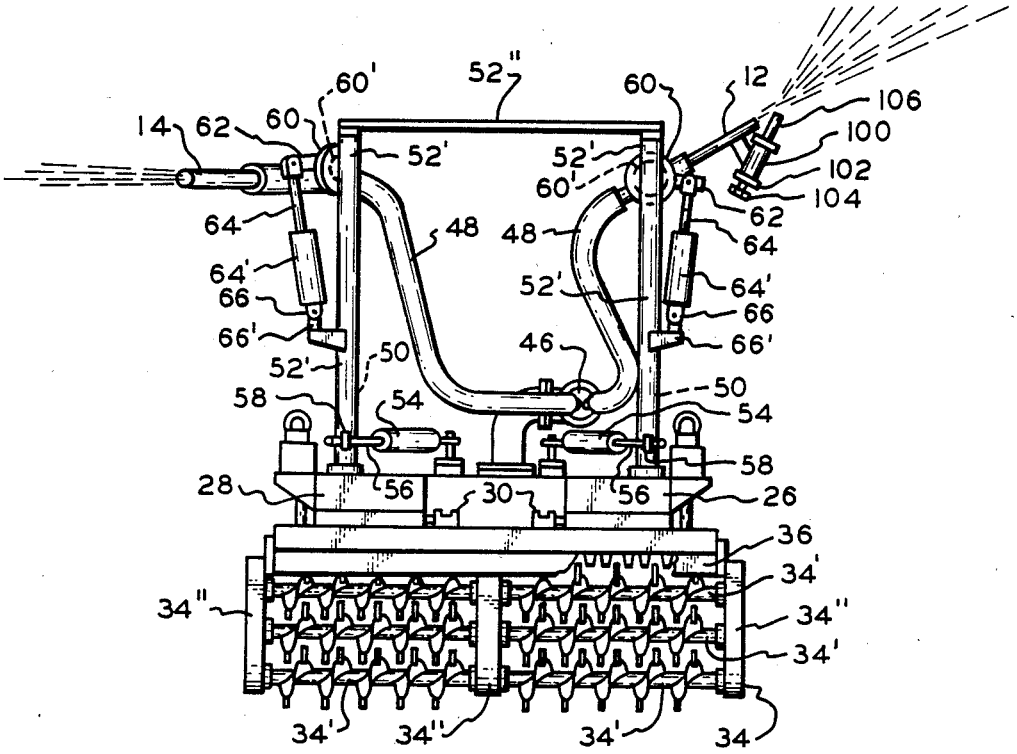
Figure 6:
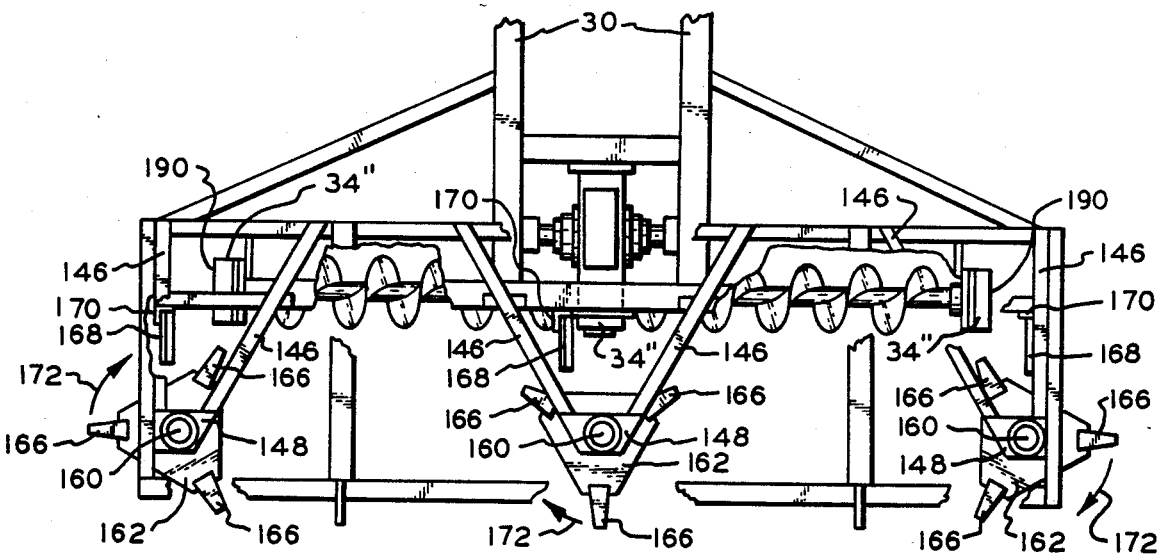
Figure 5:
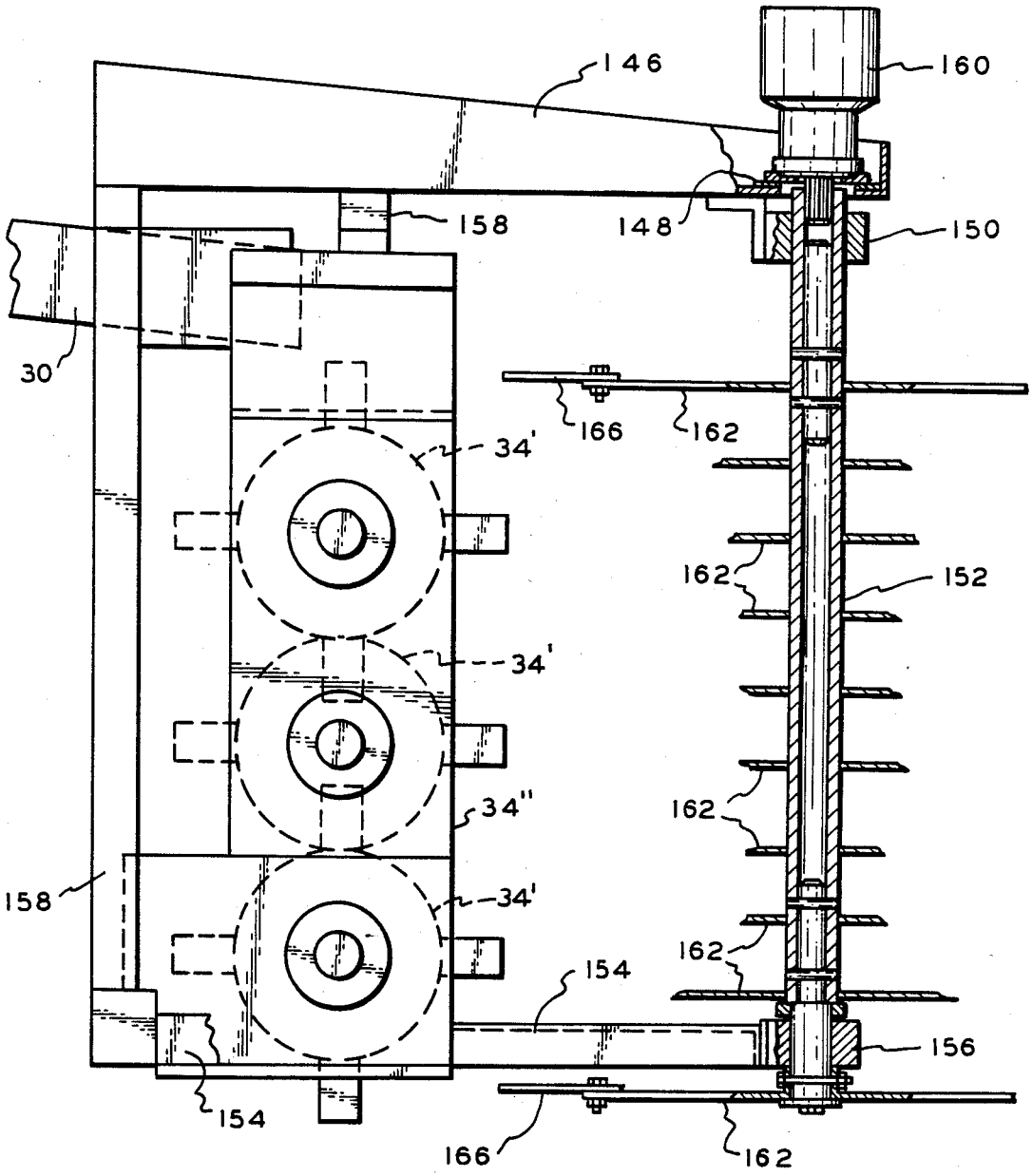
Figure 9:
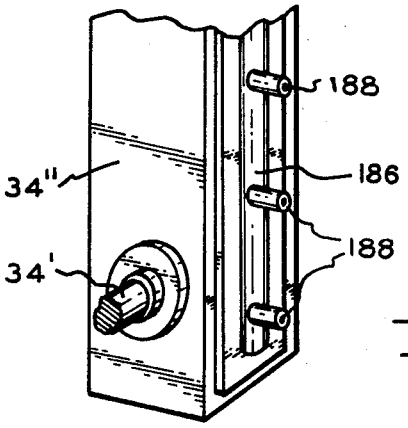
Figure 7:
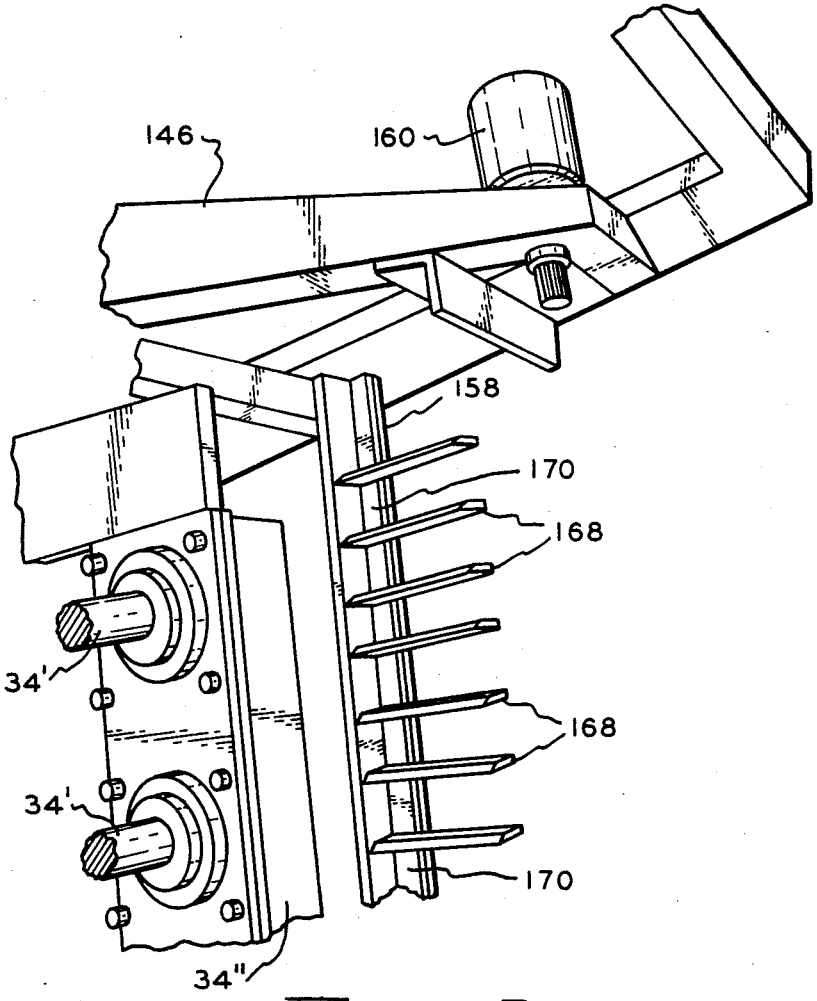
Figure 8:
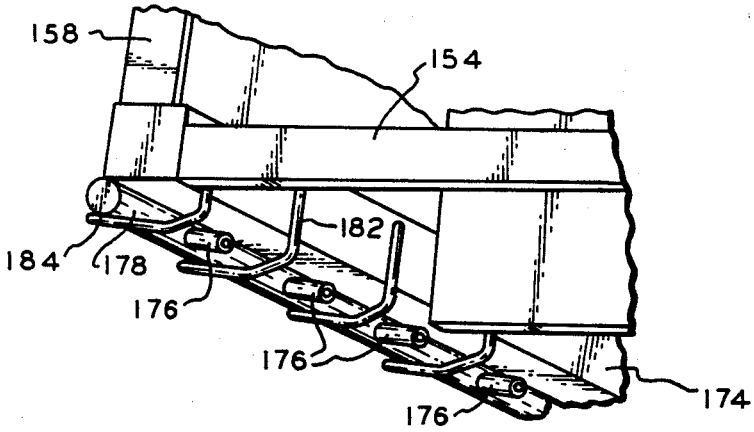

In the drawings,

FIG. 1 is a plan view of upland dredging substantially as disclosed in said copending application, FIG. 2 is a side elevation view of FIG. 1, FIG. 3 is a front view of the cutterhead of said copending application modified as to the number of augers, FIG. 4 is a schematic view of a cutterhead having water jets in the intake zone as disclosed in said copending application, FIG. 5 is a fragmentary side elevational view of the cutterhead of FIG. 4 with embracing support structure for the vertical shaft assembly, portions being shown broken, FIG. 6 is a plan view of FIG. 5, FIG. 7 is a framentary perspective view of the right hand end of FIG. 6 with the vertical shaft assembly shown removed, FIG. 8 is a fragmentary perspective view of the lower left hand corner of the embracing support structure showing a row of horizontally disposed high pressure water jets, and FIG. 9 is a modification of the means for excavating the interface forward of the cases.

In FIGS. 1 and 2, the dredge 10 is shown cutting a swath 35 in upland to provide a canal 116 to the open water 114, the nozzles 12 and 14 depositing the dredged material as a thin cover along both sides of the canal 116 with minimum impact upon the environment along the canal.

As shown, a suitable rotary excavation attachment 118 is located forward and above the cutterhead 34, being hydraulically rotated counterclockwise to engage and break up the upland. Attachment 118 may take many forms such as having a central, horizontally extended shaft 119 carrying a series of spiders 120 spaced along the shaft and having shovels or the like mounted on the outer ends of the radial arms of the spiders 120. The broken upland material is directed into the path of the cutterhead 34 and slurried as it is carried into the inlet of the pump 42 to be sprayed by the nozzles 12 and 14.

FIG. 3 is a front view of the dredge as shown in FIGS. 1 and 2 with the attachment 118 removed and the cutterhead of my U.S. Pat. No. 3,971,148 modified by adding another set of augers 34', all three sets of augers being carried in the bearing and chain cases 34''.

The hull of the dredge 10 may take any suitable form capable of providing shallow draft, stability and steerageway under the thrust propelling influence of the adjustable jet nozzles 12 and 14.

At its forward end the hull 20 is forked to provide hull portions 26 and 28 spaced to receive the two part pivoted boom 30 mounted on the pivot pins 32. At its forward end, the booms 30 carry a dredge cutterhead 34 having an added auger set 34' but otherwise conforming to that shown in said patent. Cutterhead 34 produces a box section trench or swath 35 ahead of the dredge 10 which is preferably at least slightly wider than the hull 20 to allow the dredge 10 to follow the cutterhead 34 in all water depths as well as when cutting into uplands.

In FIG. 4, a hydraulically actuated cutterhead shield 36 is shown pivotally supported about the axis 38 carried on the cutterhead 34 to provide material confinement. A flexible suction line 40 extends between the cutterhead 34 and the pump 42 which is preferably equipped with shear blades as disclosed in my copending application Ser. No. 221,219 to further comminute the solids in the slurry passing the cutterhead 34 to reduce clogging of the system to an acceptable operating level.

Discharge pipe 44 of the pump 42 has a Y-portion 46 to which are connected flexible conduits 48 extending to the inlet ends of the adjustable jet nozzles 12 and 14. Preferably the nozzles 12 and 14 are located at the forward end of the hull 20 and adjacent the cutterhead 34. In practice, this location has been found to provide the best steerageway under jet reaction propulsion and places the jets in the forward view of the operator.

The support structure for the jet nozzles 12 and 14 may comprise brackets 50 located at the front corners of the hull 20 to which fixed rigid vertical posts 52 are mounted. Rotatable sleeves 52' are carried on the posts 52 and rotated relative to the posts 52 by hydraulic cylinders 54 pivoted to the hull 20 at one end and having rods 56 pivotally connected to brackets 58 fixed to the sleeves 52'. A horizontal brace 52'' provides support for the posts 52 to better carry the reaction of the jet nozzles 12 and 14 and to assist in transferring this reaction to the hull 20.

Supporting the nozzles 12 and 14 for oscillation about horizontal axes are bearing members 60 fixed to the vertical sleeves 52'. Oscillated members 60' are supported in the members 60 to which arms 62 are fixed for pivotal connection to the rods 64 of the hydraulic cylinders 64'; the lower ends of the cylinders 64' being pivoted at 66 to arms 66' fixed to the sleeves 52'. Brackets 60'' fixed to and oscillated with the members 60' are attached to the nozzles 12 and 14.

It has been found in practice that oscillation of the sleeves 52' through an arc in the order of 160° and oscillation of the members 62 through an arc in the order of 105° is adequate for jetting of the slurry as well as for moving and steering the dredge 10. However, it will be understood that the members 60' may be so adjusted that both nozzles 12 and 14 may discharge slurry laterally of the same side of the dredge 10 or the nozzles 12 and 14 may be adjusted to avoid spraying passing traffic, specific areas, etc. along the swath being cut by the cutterhead 34.

As shown in FIG. 1, the nozzles 12 and 14 are directing the dredge spoils to opposite sides of the dredge 10 and the swath being cut by the cutterhead 34. The spray pattern 68 of the nozzle 12 being shown similar to the pattern 70 of the nozzle 14.

Referring to FIG. 3, the nozzle 12 is shown equipped with a diffuser 100 which in its simplest form comprises a threaded rod 102 having a knob 104 at one end and point 106 at the outer end which on axial adjustment intersects the jet stream of the nozzle 12 to alter its spray pattern.

To fully appreciate the departure of the method and apparatus for spoils disposal disclosed herein: all previous methods in commercial use involved piping pumped spoils to containment areas creating islands, or casting by boombucket to the immediate sides of the excavation creating artificial berms and banks alongside of the excavation. The only other alternative available was to haul the spoils by barge or ship to deep water or remote spot-disposal sites. All of these courses create environmental hazards which are presently unacceptable also. Also, such methods are inflexible and costly.

In practice, the method and apparatus of the present invention involves the slurrying of spoils ahead of the movement of a pump carrying flotation dredge or other means of conveyance; pressurizing the slurry which has been prepared for its passage through restrictive nozzles; passing the slurry through one or more nozzles to provide air-jetting distance capability using controllable diffusion and vertically and horizontally controlled nozzles to provide rainlike thin wide disbursement of spoil-slurry over large areas; such disbursement alongside the excavation being carried out with little, if any, permanent impact upon the environment.

Further, by using the reaction of the air-jetting nozzles 12 and 14 to propel and steer the dredge 10 or to at least assist therein plus providing disposal of the spoils in a continuous movement free of anchors, winching, pipes, etc., great flexibility, speed and cost reductions not previously obtainable are being experienced in demonstrations conducted under the authority of those agencies regulating the use of public waters and wet lands.

In FIG. 4 is a schematic view partially shown in broken section in which water jets 121 are shown directed at the intake 40' of the suction line 40. The water jets 121 will tend to break up material moving toward the intake 40' and reduce any tendency of clogging or cavitation.

In lieu of the attachment 118 to assist in breaking up the material to be dredged, in FIG. 4 the shield 36 is shown equipped with teeth 125 to enable the same to function in the manner of a backhoe.

Referring to FIGS. 5 and 6, the boom 30 carries the cutterhead 34 with the cases 34'' supporting the three sets of augers 34'. Embracing the boom 30 and cutterhead 34 is suitable support structure carrying the vertical shaft assemblies associated with each case 34''. As shown, the support structure comprises top horizontal members 146 converging to gussets 148 at their outer ends to carry the upper bearings 150 for the vertical shafts 152. Similar lower members 154 support the lower bearing 156. Members 146 and 154 are held in vertical spaced relation by vertical frame members 158. Suitable hydraulic motors 160 are connected to the upper ends of each shaft 152 to rotate the same in the bearings 150 and 156.

Each shaft 152 is disposed directly in front of each case 34'' and supports for rotating vertically spaced tilling members 162 in the form of three sided plates 162 having tines or knives 166 located 120° apart. On rotation the knives 166 have clearance with the vertical faces of the cases 34'', the sweep of the knives 166 being at least equal to the width of the cases 34'' so as to clear the way for the surface of the case presented to the material being excavated. To avoid confusion, in FIG. 5 only a few disc 162 are shown in full line, the remainder are shown broken. Spaced supports (not shown) are provided between adjacent plates 162 and spaced inwardly from the knives 166.

All of the plates 162 may be the same. However, they are preferably arranged on the shaft 152 whereby the knives 166 of adjacent plates 162 are in spiral offset to reduce the torque on the motor 160 when the interface of the consolidated material to be excavated is engaged by the knives 166. By arranging the spiral offset in opposite directions from a point opposite the intake of the cutterhead, the plates 162 tend to direct the spoils toward the intake. A similar effect will be obtained by deflecting the knives 166 to provide a pitch effect.

To clean the knives 166 and to remove material that may be carried by the knives 166, cleaner bars or knives 168 are provided in spaced vertical arrangement corresponding to the vertical spacing of the members 162. Knives 168 are attached at their inner end to a common vertical support 170 and project into overlapping relation with the knives 166. The motors 160 are rotated in the directions indicated by the arrows 172.

In the event that embracing support structure for the vertical shaft assemblies which till the consolidated soils at the interface forward of the cases 34'' presents an abutment to the interface such as the frame member 174 of FIG. 8, a row of spaced high pressure water jet nozzles 176 may be provided in spaced relation and directed toward the interface between the consolidated material to be excavacated and the water supply of the waterway used to form a slurry. Nozzles 176 are shown mounted on a supply pipe 178 attached to the member 174 by the angle rods 180 welded at 182 to the member 174 and at 184, the rods 180 also acting as guards for the nozzles 176.

In FIG. 9 is shown a modification to perform the same function as the vertical shaft assemblies carrying the plates 162 and knives 166. In the illustration, the case 34'' carries a supply pipe 186 connected to a source of high pressure water. Nozzles 188 connected to the pipe 186 direct a vertical sheet of water against the interface forward of the case 34'' to excavate that area of the interface in opposed relation to the forward face of the case 34''.

It will be noted from FIG. 6 that the sweep of the knives 166 extends well beyond the side faces 190 of the outer cases 34''. This assures a flow of the water supply to form the slurry around the ends of the cutterhead 34.

The means for moving the dredge into the interface between the consolidated soil and the water supply may take many forms. Aside from jet reaction, outboard as well as inboard engines driving propeller may be used. A separate craft such as a tugboat may be used to provide controlled continuous forward movement along the longitudinal axis of the swatch being cut.

The high pressure water jets 176 and 188 are shown used to excavate limited areas of the interface of the consolidated soil. It is anticipated that the use of such jets may be enlarged to excavate more of the interface even to the exclusion of the auger 34' wherein the cutterhead of the dredge would consist only of high pressure water jets presented to the interface in the most effective patterns.

I claim:

1. Dredging apparatus comprising flotation structure, a cutterhead mounted on the forward end of said structure, a plurality of parallel horizontally disposed power-driven augers each having a central region and outer ends mounted on said cutterhead for cutting a swath in an interface between consolidated soil and a water source and for moving a slurry along paths angularly disposed to the longitudinal axis of said swath toward an intake zone adjacent said augers' central region, vertically disposed auger supporting bearing and transmission cases mounted upon said cutterhead, said cases including a pair of outer cases supporting said augers' outer ends and a central case supporting said augers' central region, a substantially vertical shaft rotatably mounted upon said cutterhead ahead of each of said cases extending a vertical distance substantially corresponding to the vertical height of said cases, power means rotating said shafts, interface cutting means mounted on said shafts axially spaced thereon and defining a cutting region having a horizontal width greater than the horizontal dimension of the associated case, said interface cutting means comprising a plurality of axially spaced plates mounted upon said shafts axially spaced thereon, a plurality of knives mounted upon each plate, a fixed cleaner bar support mounted upon said cutterhead adjacent said vertical shafts and substantially parallel thereto, a plurality of spaced elongated parallel knife cleaner bars fixed upon said cleaner bar support each extending adjacent one of said plates whereby each of said knives mounted on a plate passes adjacent a cleaner bar in a shearing relation during each shaft rotation to clean said knives of foreign matter, and suction means having an inlet at said intake zone.

2. Dredging apparatus comprising flotation structure, a cutterhead mounted on the forward end of said structure, means on said cutterhead for cutting a swath of one width in an interface between consolidated soil and a water source and for moving a slurry along paths angularly disposed to the longitudinal axis of said swath toward an intake zone, said means for cutting a swath including a plurality of horizontally disposed rotating shafts having cutting elements mounted thereon, and each having outer ends and a central region, a vertically oriented case defined on said cutterhead at each outer end and at said central region of said shafts rotatably supporting said shafts and housing shaft bearing and drive means, a plurality of jets mounted on each case for directing high pressure water jets in a forward direction of said cutterhead, said jets being vertically spaced along the entire vertical dimension of the associated case, and suction means defining an intake zone rearwardly of said shafts' central region.

* * * * *